US008905045B2

(12) United States Patent
Byun

(10) Patent No.: US 8,905,045 B2
(45) Date of Patent: Dec. 9, 2014

(54) CASE FOR LIQUID STATE COSMETICS

(71) Applicant: Young-Kwang Byun, Seoul (KR)

(72) Inventor: Young-Kwang Byun, Seoul (KR)

( * ) Notice: Subject to any disclaimer, the term of this patent is extended or adjusted under 35 U.S.C. 154(b) by 0 days.

(21) Appl. No.: 13/968,696

(22) Filed: Aug. 16, 2013

(65) Prior Publication Data

US 2014/0076341 A1 Mar. 20, 2014

(30) Foreign Application Priority Data

Sep. 19, 2012 (KR) ..... 10-2012-0104143

(51) Int. Cl.

| | |
|---|---|
| ***A45D 24/22*** | (2006.01) |
| ***A45D 34/04*** | (2006.01) |
| ***A45C 13/00*** | (2006.01) |
| ***A45D 19/02*** | (2006.01) |
| ***A45D 24/28*** | (2006.01) |
| ***B05B 11/00*** | (2006.01) |
| *A45D 19/00* | (2006.01) |

(52) U.S. Cl.

CPC ..... *A45D 34/04* (2013.01); *A45C 13/008* (2013.01); *A45D 19/02* (2013.01); *A45D 24/28* (2013.01); *A45D 34/042* (2013.01); *B05B 11/0054* (2013.01); *B05B 11/3004* (2013.01); *B05B 11/3015* (2013.01); *A45D 2019/0066* (2013.01); *A45D 2200/055* (2013.01); *B05B 11/0037* (2013.01); *B05B 11/0048* (2013.01); *B05B 11/3026* (2013.01)

USPC ..... 132/116; 222/256; 222/321.7

(58) Field of Classification Search

USPC ..... 132/112–116; 401/188 R, 183–186; 222/256, 321.7, 321.2

See application file for complete search history.

(56) References Cited

U.S. PATENT DOCUMENTS

| | | | | |
|---|---|---|---|---|
| 2005/0082315 | A1* | 4/2005 | Hayakawa et al. | 222/192 |
| 2008/0060665 | A1* | 3/2008 | Umeno et al. | 132/112 |
| 2010/0139677 | A1* | 6/2010 | Tsai | 132/74.5 |

FOREIGN PATENT DOCUMENTS

KR 10-2012-0080696 A 7/2012

* cited by examiner

*Primary Examiner* — Rachel Steitz

(74) *Attorney, Agent, or Firm* — Kaplan Breyer Schwarz & Ottesen, LLP

(57) ABSTRACT

An airtight liquid cosmetic container is provided. The container includes a body configured to eject liquid contents through an ejection hole, a container inserted into the body through an opening of the body to be slidable and filled with the liquid contents therein, a container cap coupled with an inlet, and a valve unit allowing the liquid contents in the container to be transferred to the ejection hole of the body while pressing the container and blocking the transfer of the liquid contents while releasing a force of pressing the container. The valve unit includes an opening and closing element sliding together with the container and the container cap, allows the opening and closing element to open a transfer path of the liquid contents to be ejected while the container is being pressed, and allows the opening and closing element to block an ejection of the liquid contents.

6 Claims, 17 Drawing Sheets

CASE FOR LIQUID STATE COSMETICS

CROSS-REFERENCE TO RELATED APPLICATION(S)

Korean Patent Application KR 10-2012-0104143 with a filing date of Sep. 19, 2012, is incorporated herein by reference.

BACKGROUND OF THE INVENTION

1. Field of the Invention

The present invention relates to a liquid cosmetic container configured to eject the liquid cosmetics, and more particularly, to a cosmetic container for ejecting liquid dyes used for coloring hair.

2. Description of the Related Art

Generally, to color hair, a container filled with hair dyes is squeezed and applied to a brush used for dye dyes are put into an additional container and applied to a brush to be used.

However, in general methods of coloring hair, there are limitations such as being performed with troubles and as staining clothes or periphery thereof due to dyes falling while being applied from containers to brushes or being transferred to hair.

Additionally, it is necessary to apply dyes to brushes again when running out of dyes previously applied to the brushes, which is cumbersome and takes a long time.

To overcome such limitations, Korean Patent Publication No. 10-2012-0080696, titled with Dyeing container comb with type of toothpaste (hereinafter, referred to as Cited Reference, discloses a technology of ejecting dyes to a comb for dyeing hair, coupled with a container.

In the comb coupled with the container, when pushing a malleable body of the container, dyes are ejected to a brush, thereby simply dyeing hair.

However, in the case of the comb coupled with the container, it is difficult to control an amount of dyes ejected to the brush and it is easy that the dyes may leak while being not used. Accordingly, while being used, the periphery thereof becomes polluted and a great loss of the dyes may occur.

SUMMARY OF THE INVENTION

Accordingly, the present invention is directed to an improved airtight liquid cosmetic container, capable of controlling an amount of ejected contents and of preventing a leakage of the contents while not being used, which substantially obviates one or more problems due to limitations and disadvantages of the related art.

According to an aspect of the present invention, there is provided a improved airtightness liquid cosmetic container includes a body configured to eject liquid contents through an ejection hole, a container inserted into the body through an opening of the body to be slidable and filled with the liquid contents therein, a container cap coupled with an inlet of the container, and a valve unit allowing the liquid contents in the container to be transferred to the ejection hole of the body while pressing the container and blocking the transfer of the liquid contents while releasing a force of pressing the container. The valve unit includes an opening and closing element sliding together with the container and the container cap, allows the opening and closing element to open a transfer path of the liquid contents to be ejected while the container is being pressed, and allows the opening and closing element to block an ejection of the liquid contents by closing the transfer path of the liquid contents while the force of pressing the container is released.

The valve unit may include a nozzle penetrating the container cap and formed with a nozzle hole connected to the ejection hole therein and with an inflow hole connected to the nozzle hole and allowing the liquid contents to flow into the nozzle hole on a side thereof, a sliding element put on the outside of the nozzle to be movable and pushed by the container cap and sliding toward the ejection hole while the container and the container cap are sliding toward the ejection hole, an elastic element elastically supporting the sliding element with respect to the ejection hole and restoring the sliding element to a former condition when a force of pushing the container and the container cap is released, and the opening and closing element put on the outside of the nozzle to be movable, pushed toward the ejection hole and opening the inflow hole due to a pressure of the liquid contents flowing into a gap between the container and the nozzle while the sliding element is sliding toward the ejection hole, and pushed by the sliding element to be restored to a former condition and blocking the inflow hole when the sliding element is restored to the former condition.

The nozzle may include a nozzle body formed with the nozzle hole whose one end is open therein and with the inflow hole on a side thereof and a loop-shaped protrusion formed on a location in the side of the nozzle body, separated from the inflow hole to another end of the nozzle body and formed with minute holes through which the liquid contents flowing into a gap between the other end of the nozzle body and the container cap pass. The opening and closing element may be put on a part of the nozzle body to be movable, where the minute holes are formed, with the loop-shaped protrusion as a reference. When the sliding element slides toward the ejection hole and a force of pushing the opening and closing element toward the loop-shaped protrusion is released, the liquid contents flowing into the container cap may apply a pressure to the opening and closing element through the minute holes and may push the opening and closing element to slide toward the ejection hole.

The valve unit may further include a connection hole in the body, the connection hole connecting the ejection hole to the nozzle and supporting the elastic element.

The connection hole may include a connection part formed as a hollow tube whose one end is inserted into a valve connection part extended to be the ejection hole in the body, an open end of the nozzle body being inserted into another end thereof, the elastic element being put on the outside of the other end and an elastic element supporting part extended outwardly from the connection part and supporting the elastic element.

The container cap may include a screw-coupled element having a cylindrical shape and coupled with the opening of the container, a blocking plate vertically extended from one end of the screw-coupled element toward the inside and blocking a discharge of the liquid contents in the container, and a nozzle insertion element, which is hollow inside, extended to be orthogonal to a center of the blocking plate, the nozzle being inserted therein to be slidable.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, an improved airtight liquid cosmetic container according to an embodiment of the present invention will be described with reference to the attached drawings.

Figure 1:
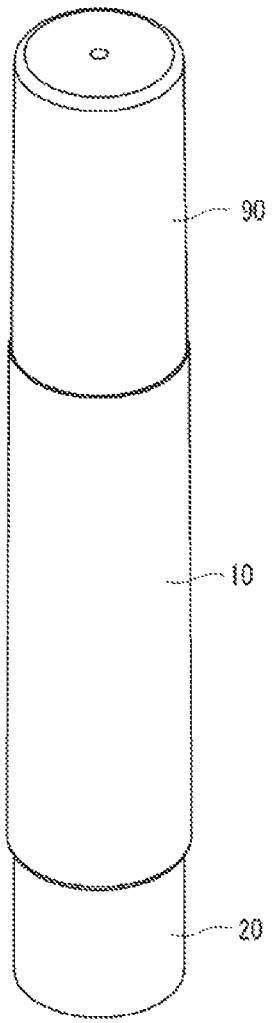
FIG. 1 is a perspective view illustrating an improved airtight liquid cosmetic container.
Figure 2:
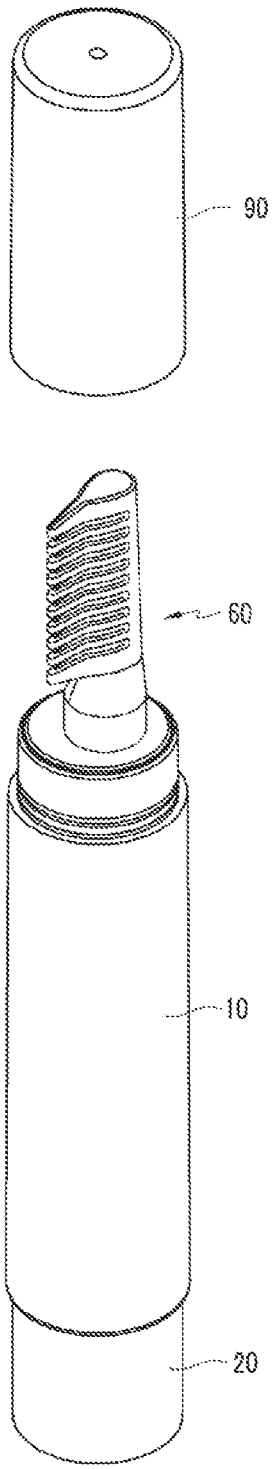
FIG. 2 is an exploded perspective view illustrating the container of FIG. 1.
Figure 3:
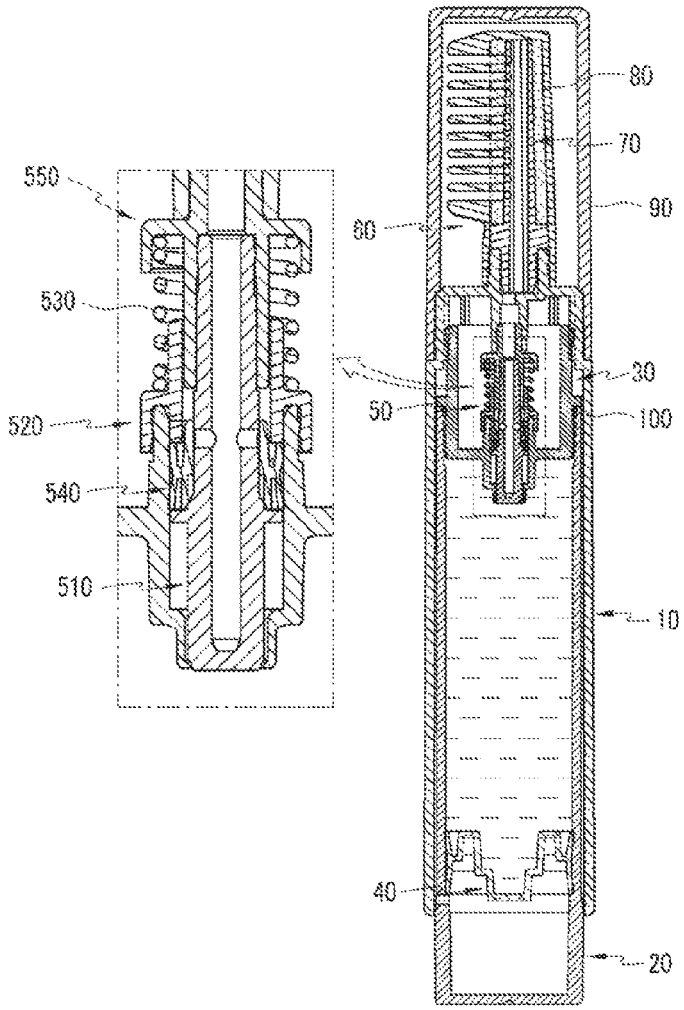
FIG. 3 is a longitudinal cross-sectional view illustrating the container of FIG. 1.

FIG. 1 is a perspective view illustrating an improved airtight liquid cosmetic container, FIG. 2 is an exploded perspective view illustrating the container, and FIG. 3 is a longitudinal cross-sectional view illustrating the container.

The liquid cosmetic container with improved airtightness includes a body 10, a container 20, a container cap 30, a pressing holder 40, a valve unit 50, a comb 60, a lining 70, a filter element 80, and a cover 90.

The body 10 is formed as a cylinder with an open end, through which the container 20 is inserted to be slidable, and is configured to allow liquid contents therein to be ejected to the comb 60 through another closed end thereof.

The container 20 is formed as a cylinder with an open end, the container 20 being filled with liquid contents such as dyes. The container 20 is inserted into the body 10 to be slidable in such a way that the open end is located inside the body 10.

The container cap 30 is screw-coupled with the inside of the open end of the container 20 to prevent the liquid contents in the container 20 from being poured. Outside the container cap 30, there is provided an airtight ring 100 for preventing a leakage of the liquid contents at a gap between the container cap 30 and the container 20 by maintaining airtightness between the container cap 30 and the container 20 while the container cap 30 is being screw-coupled with the container 20. The liquid contents are ejected through a central part of the container cap 30.

The pressing holder 40 is inserted into the container 20 to be slidable and pushes the liquid contents in the container to an ejection side of the container 20, that is, to the container cap 30 in such a way that the liquid contents are smoothly ejected. The liquid contents fill a gap between the container cap 30 and the pressing holder 40 in the container 20.

The valve unit 50 is connected to an ejection side of the body 10 and the container cap 30 and controls a transfer of the liquid contents in such a way that the liquid contents in container 20 is to be ejected to the comb 60 located outside the body 10 through the ejection side of the body 10 while the container 20 is being pressed. The valve unit 50 allows the liquid contents to be ejected only while the container 20 is being pushed but prevents a leakage of the liquid contents by blocking the ejection of the liquid contents while the container 20 is not being pushed. Also, an ejection amount is controlled to allow a certain amount of the liquid contents to be ejected while being used.

The valve unit 50 includes a nozzle 510, a sliding element 520, a spring 530, an opening and closing element 540, and a connection hole 550.

The comb 60 is connected to the ejection side of the body 10 at the outside of the body 10 to comb hair while dyeing. Inside the comb 60, a transfer space is formed to allow the liquid contents ejected from the body 10 to be transferred.

The lining 70 is inserted into the transfer space inside the comb 60 and transfers the liquid contents ejected from the body 10, thereby evenly supplying the liquid contents to intervals between teeth of the comb 60, which will be described below.

A filter 80 surrounds the lining 70 in the transfer space of the comb 60 to allow the liquid contents ejected through the lining 70 to be evenly supplied to intervals of the teeth of the comb 60.

The cover 90 is coupled with the ejection side of the body 10 to be detachable, which is separated from the body 10 to allow the comb 60 to be exposed outwardly while being used. When not being used, the cover 90 is coupled with the body 10 and covers the comb 60 not to be exposed outwardly.

Figure 4:
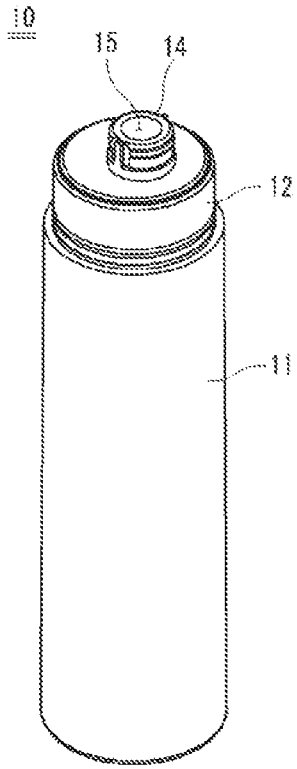
FIG. 4 is a perspective view illustrating a body shown in FIG. 2.
Figure 5:
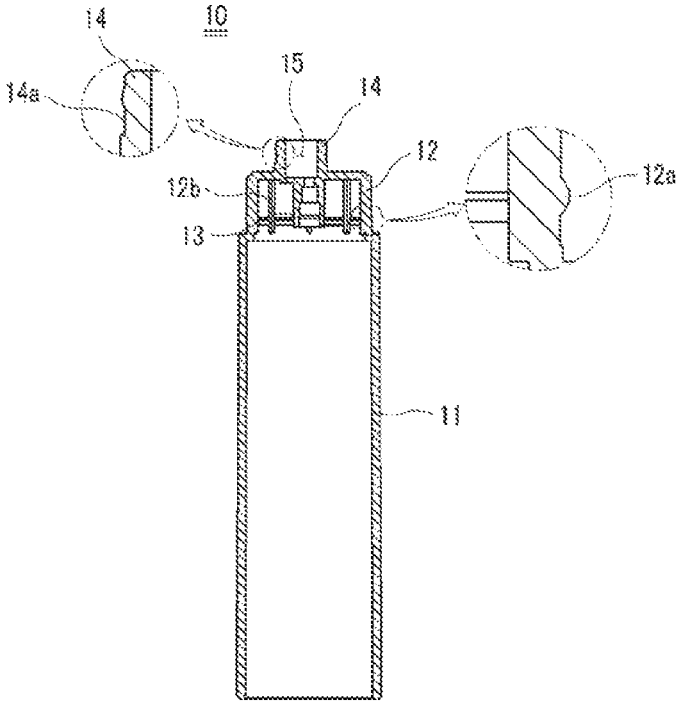
FIG. 5 is a longitudinal perspective view illustrating the body of FIG. 4.

FIG. 4 is a perspective view illustrating the body 10, and FIG. 5 is a longitudinal cross-sectional view illustrating the body 10.

The body 10 includes a hollow container sliding element 11 formed as a hollow cylinder in which the container 20 slides, a cover coupling element 12 extended from one end of the container sliding element 11 and having an inner diameter and an outer diameter more reduced than those of the container sliding element 11 and a front, which is closed, the cover 90 putted outside the cover coupling element 12 to be detachable, a hollow valve connection element 13 extended from a front center of the cover coupling element 12 to the inside of the cover coupling element 12 and connected to the valve unit 50, and a hollow comb connection element 14 extended from a location eccentric from the center of the front of the cover coupling element 12 to an outer front of the cover coupling element 12, which is connected to the comb 60 and the lining 70.

The valve connection element 13 and the comb connection element 14 are connected to each other through an ejection hole 15.

The inside of the valve connection element 13 is formed as a step to restrict the insertion of the valve unit 50. That is, the valve unit 50 is inserted only into the step in the valve connection element 13.

A fastening protrusion 12*a* to which the cover 90 is fastened is protruded from an outer surface of the cover coupling element 12, and a fastening groove 14*a* to which the comb 60 is fastened is formed on an outer surface of the comb connection element 14.

A plurality of ribs 12*b* for reinforcement is protruded in a radial shape on an inner circumferential surface of the cover coupling element 12.

On the other hand, the comb connection element 14 is formed on the location eccentric from the frontal center of the cover coupling element 12 due to a structure in which the teeth of the comb 60 is biased in one direction.

Figure 6:
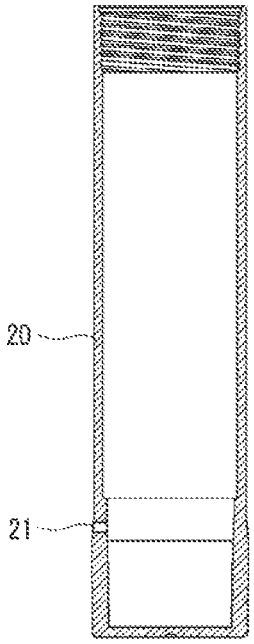
FIG. 6 is a cross-sectional view illustrating the container of FIG. 2.

FIG. 6 is a cross-sectional view illustrating the container 20.

One end of the container 20 is opened and another end thereof is closed, in which a space capable being filled with the liquid contents is formed. A screw thread is formed on an inner circumferential surface of the one open end of the container to allow the container cap 30 to be coupled therewith. An air inflow hole 21 is formed on an outer circumferential surface of the other end of the container 20 to allow the air to flow into a gap between the pressing holder 40 inserted into the container 20 and the closed other end of the container 20.

A step is formed on the inside of the other end of the container 20 to prevent the pressing holder 40 from sliding toward the other end of the container 20. As described above, the step prevents the pressing holder 40 from sliding toward the other end of the container 20 in such a way that the pressing holder 40 prevents the air inflow hole 21 from being blocked.

Figure 7:
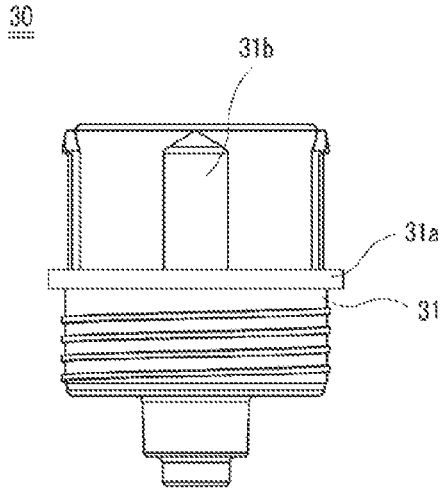
FIG. 7 is a side view illustrating a container cap shown in FIG. 2.
Figure 8:
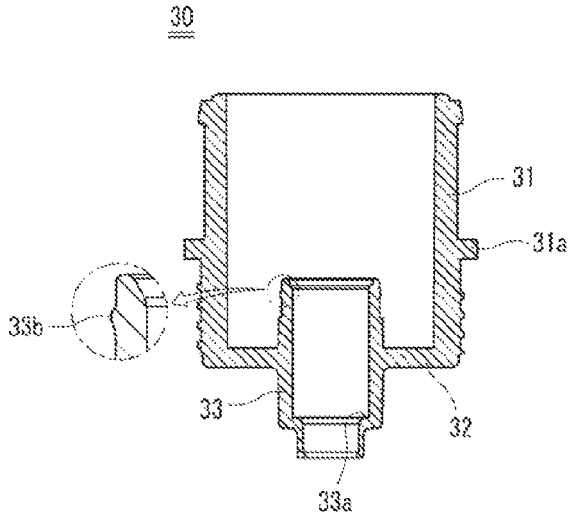
FIG. 8 is a longitudinal cross-sectional view illustrating the container cap of FIG. 7.

FIG. 7 is a side view illustrating the container cap 30, and FIG. 8 is a longitudinal cross-sectional view illustrating the container cap 30.

The container cap 30 includes a screw-coupled element 31, a blocking plate 32, and a nozzle insertion element 33.

The screw-coupled element 31 is formed as a cylinder and has a screw thread formed on the outside thereof to be screw-coupled with the container 20 in an open part thereof. An insertion prevention protrusion 31*a* having a loop shape preventing the screw-coupled element 31 not to be more inserted into the container 20 is protruded in a center of an outer circumferential surface of the screw-coupled element 31. The screw thread is formed only in another end of the screw-coupled element 31 with the insertion prevention protrusion 31*a* as a center. A guide protrusion 31*b* inserted into a gap between the ribs 12*b* formed inside the body 10 and preventing the rotation of the container cap 30 in the body 10 and guiding the sliding of the container cap 30.

The blocking plate 32 is vertically extended from the other end of the screw-coupled element 31 toward the inside thereof and blocks a discharge of the liquid contents in the container 20.

The nozzle insertion element 33 is extended forward and backward of the blocking plate 32 from a central part of the blocking plate 32 and is formed to be hollow, into which a nozzle of the valve unit 50, which will be described below is inserted to be slidable. One of both ends of the nozzle insertion element 33, which is extended backward of the blocking plate 32, that is, extended outwardly, is formed as a step to prevent the nozzle from being separated backward from the blocking plate 32. A gap is formed between a step part 33*a* of the nozzle insertion element and the nozzle, through which the liquid contents in the container 20 flows into the nozzle insertion element 33. A protrusion 33*b* on which the sliding element 520 that will be described below is hung is formed on another of the both ends of the nozzle insertion element 33, which is located in the blocking plate 32.

Figure 9:
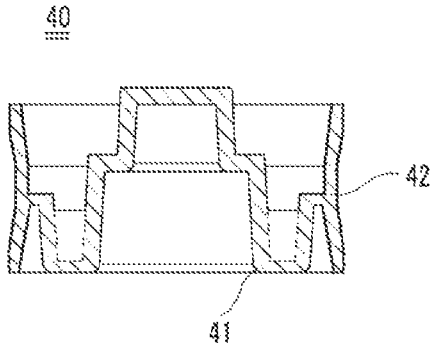
FIG. 9 is a cross-sectional view illustrating a pressing holder shown in FIG. 2.

FIG. 9 is a cross-sectional view illustrating the pressing holder 40.

The pressing holder 40 includes a pressing element 41 inserted into the container 20 and pushing the liquid contents to the ejection side of the body 10 and a contact element 42 formed on an edge of the pressing element 41 and being in contact with an inner circumferential surface of the container to be slidable. The contact element 42 is formed in such a way that a central part thereof is more depressed toward a central part of the pressing element 41 than both ends thereof. Accordingly, the central part of the contact element 42 is not in contact with the inner circumferential surface of the container 20 and only the both ends thereof is in contact with the inner circumferential surface of the container 20 to be slidable.

Figure 10:
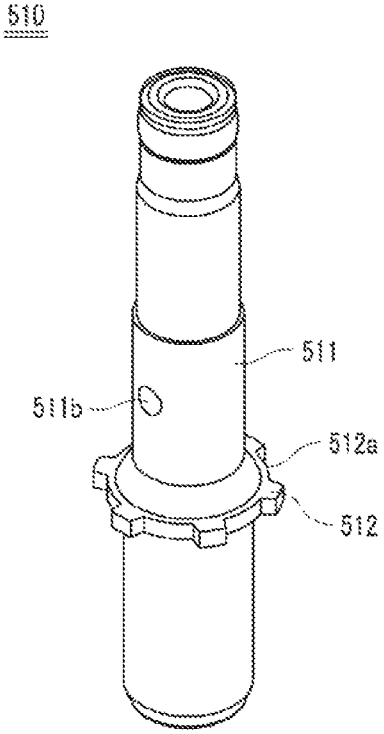
FIG. 10 is a perspective view illustrating a nozzle shown in FIG. 2.
Figure 11:
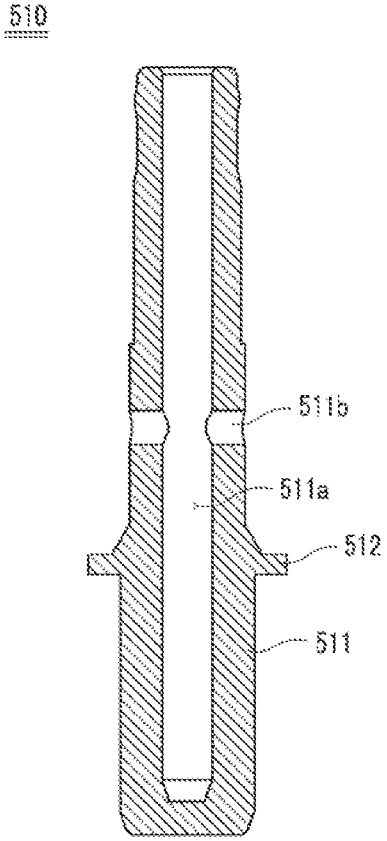
FIG. 11 is a longitudinal cross-sectional view illustrating the nozzle of FIG. 10.

FIG. 10 is a perspective view illustrating the nozzle 510, and FIG. 11 is a longitudinal cross-sectional view illustrating the nozzle 510.

The nozzle 510 is installed penetrating the nozzle insertion element 33 of the container cap 30 to be movable and includes a nozzle body 511 and a loop-shaped protrusion 512.

In the nozzle body 511, a nozzle hole 511*a* with an open end is formed to be long, and an inflow hole 511*b* connected to the nozzle hole 511*a* is formed on a side thereof. The nozzle hole 511*a* is connected to the ejection hole 15 of the body 10 through the connection hole 550 and transfers the liquid contents to the ejection hole 15. The inflow hole 511*b* allows the liquid contents flowing into the nozzle insertion element 33 of the container cap 30 to flow into the nozzle hole 511*a* through a gap between the nozzle insertion element 33 and the nozzle 510.

The loop-shaped protrusion 512 is formed on a location separated from the inflow hole 511*b* of a side of the nozzle body 511 to the other closed end of the nozzle body 511 and restricts sliding not to allow the container cap 30 to slide forward because the step part 33*a* formed on the nozzle insertion element 33 is hung thereon.

The loop-shaped protrusion 512 is formed with a plurality of minute holes 512*a* through which the liquid contents flowing into the gap between the other end of the nozzle body 511 and the container cap 30 passes.

Figure 12:
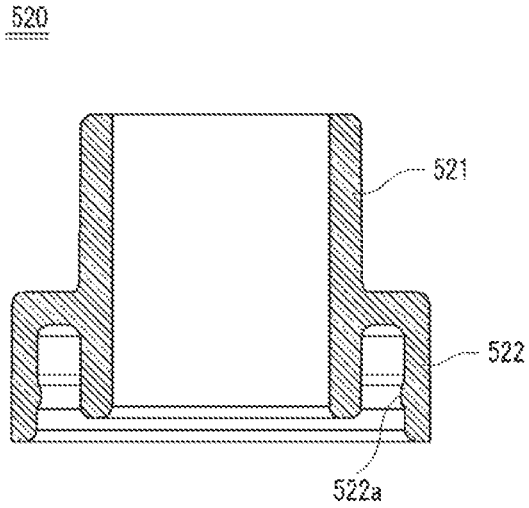
FIG. 12 is a cross-sectional view illustrating a sliding element shown in FIG. 2.

FIG. 12 is a cross-sectional view illustrating the sliding element 520.

The sliding element 520 is elastically supported by the connection hole 550 using the spring 530 and includes a sliding element 521 having a cylindrical shape put on the outside of the connection hole 550 to be slidable and an insertion element 522 bent and extended from the outside of the sliding element 521 toward one end to allow the nozzle insertion element 33 of the container cap 30 to be inserted into a gap between the one end of the sliding element 521 and the insertion element 522.

One of both ends of the nozzle insertion element 33, which is located in the container cap 30, is inserted into the insertion element 522. One end of the spring 530 is in contact with the connection hole 550 and supported and another end thereof is inserted into another end of the sliding element 521 and is in contact with the insertion element 522 and supported.

The sliding element 520 is pushed toward the ejection hole 15 of the body 10 by the container cap 30 moving together with the container 20 while a user is pressing the container and is restored to a former condition by a restoration force of the spring 530 and pushes the container cap 30, the container 20, and the opening and closing element 540 to a former condition while releasing a force of pressing the container 20.

A protrusion 522*a* hung on the protrusion 33*b* of the nozzle insertion element 33 to allow the sliding element 520 to be coupled with the container cap 30 and to slide together is formed on an inner surface of the insertion element 522.

Figure 13:
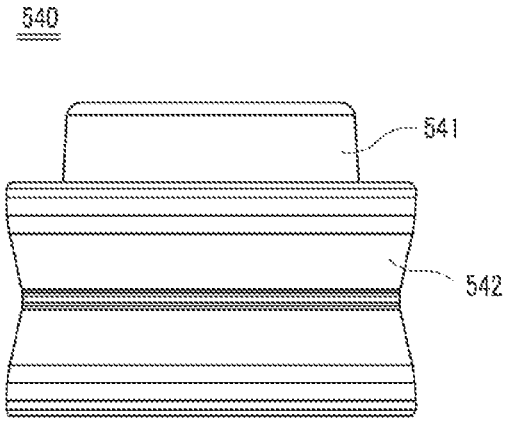
FIG. 13 is a side view illustrating an opening and closing element shown in FIG. 2.
Figure 14:
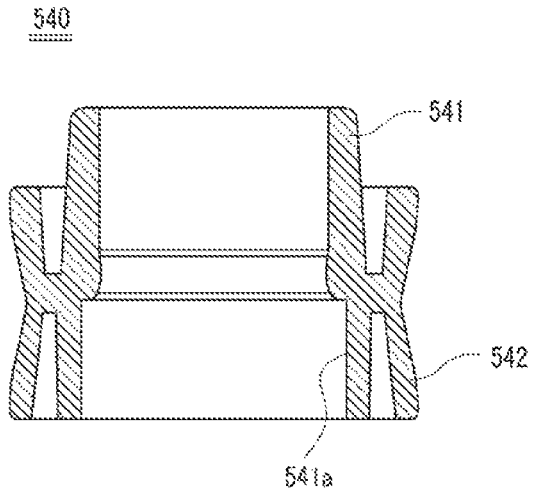
FIG. 14 is a longitudinal perspective view illustrating the opening and closing element of FIG. 13.

FIG. 13 is a side view illustrating the opening and closing element 540, and FIG. 14 is a longitudinal cross-sectional view illustrating the opening and closing element 540.

The opening and closing element 540 is put on the outside of the nozzle body 511. The opening and closing element 540 is pushed toward the ejection hole 15 due to a pressure of the liquid contents flowing into a gap between the container cap 30 and the nozzle body 511 and opens the inflow hole 511*b* of the nozzle body 511 while the sliding element 520 slides toward the ejection hole 15 of the body 10. The opening and closing element 540 is pushed by the sliding element 520 to be restored to the former condition when the sliding element 520 is restored to the former condition. In this case, the opening and closing element 540 is put on a part where the inflow hole 511*b* is formed, to be movable with the loop-shaped protrusion 512 of the nozzle body 511 as a reference.

While the sliding element 520 is restored to the former condition, the opening and closing element 540 slides only to be in contact with the loop-shaped protrusion 512 of the nozzle 510 and a further sliding is prevented by the loop-shaped protrusion 512. Together with this, the sliding of the sliding element 520, the container cap 30, and the container 20 are limited.

The opening and closing element 540 includes a hollow opening and closing part 541 put on the outside of the nozzle body 511 and a contact part 542 extended outwardly from the opening and closing part 541 and in contact with the nozzle insertion element 33 of the container 30 to slidable.

A gap groove 541*a* not in contact with the nozzle body 511 and forming a gap therebetween is formed on a part of an inner circumferential surface of the opening and closing part 541 toward the loop-shaped protrusion 512 of the nozzle 510. Accordingly, when the opening and closing part 541 slides toward the ejection hole 15 in such a way that the gap groove 541*a* overlaps the inflow hole 511*b*, the liquid contents flowing into the gap groove 541*a* flows into the nozzle hole 511*a* through the inflow hole 511*b*. On the contrary, when the opening and closing part 541 slides toward the loop-shaped protrusion 512 and locations of the gap groove 541*a* and the inflow hole 511*b* do not overlap each other, an inflow of the liquid contents through the inflow hole 511*b* is blocked by the inner circumferential surface of the opening and closing part 541 in contact with the nozzle body 511.

A center of the contact part 542 is formed to be more depressed toward the inside of the opening and closing part 541 than both ends thereof in such a way that the center of the contact part 542 is not in contact with an inner circumferential surface of the nozzle insertion element 33 but only the both ends are in contact with the inner circumferential surface of the nozzle insertion element 33 to be slidable.

Figure 15:
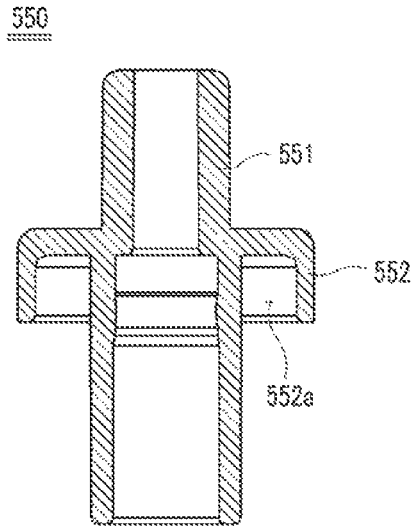
FIG. 15 is a cross-sectional view illustrating a connection hole shown in FIG. 2.

FIG. 15 is a cross-sectional view illustrating the connection hole 550.

The connection hole 550 connects the ejection hole 15 and the nozzle 510 to each other and supports the spring 530 in the body 10, which includes a connection part 551 and an elastic element supporting part 552.

The connection part 551 is formed to be a hollow tube, whose one end is inserted into and fastened to the valve connection part 13 of the body 10. An open end of the nozzle body 511 is inserted into another end of the connection part 551. The spring 530 is put on the outside of the other end of the connection part 551.

The elastic element supporting part 552 is extended outwardly from the connection part 551 and supports the spring 530, which forms a spring insertion groove 552*a* between the elastic element supporting part 552 and the connection part 551.

Figure 16:
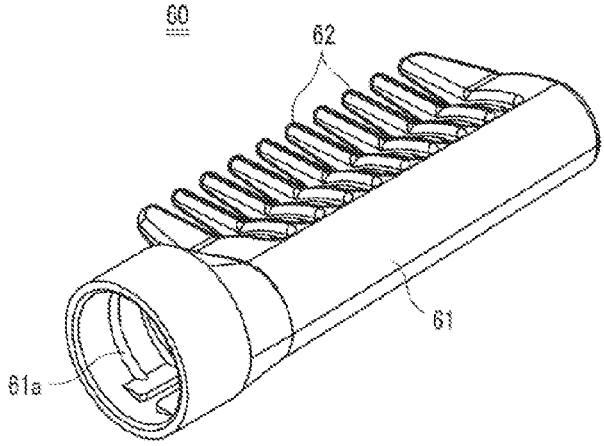
FIG. 16 is a perspective view illustrating a comb shown in FIG. 2.
Figure 17:
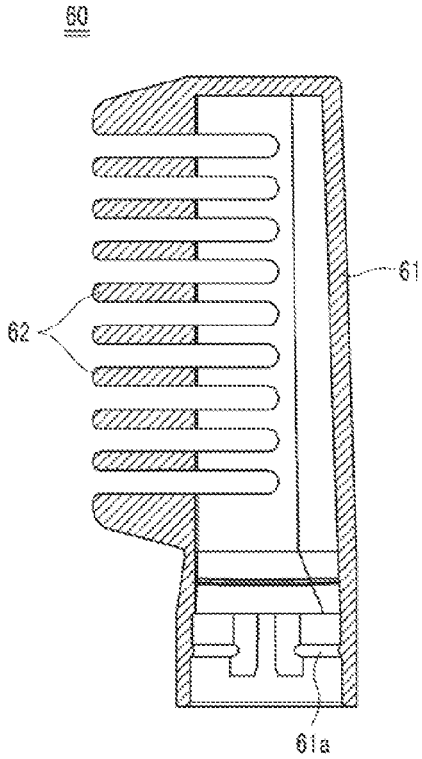
FIG. 17 is a longitudinal cross-sectional view illustrating the comb of FIG. 16.

FIG. 16 is a perspective view illustrating the comb 60, and FIG. 17 is a longitudinal cross-sectional view illustrating the comb 60.

The comb 60 is for combing hair and includes a transfer element 61 to which the liquid contents ejected through the ejection hole 15 of the body is transferred and a plurality of teeth 62 formed on a side of the transfer element 61 to be separated from one another.

A transfer space with an open end is formed in the transfer part 61. The open end of the transfer element 61 is put on the outside of comb connection element 14 formed on the body 10 and is fastened thereto. A fastening protrusion 61*a* inserted into the fastening groove 14*a* formed on the comb connection element 14 and preventing a separation of the transfer element 61 is formed in the transfer part 61.

Since the interval between the teeth 62 is open and is connected to the transfer space in the transfer part 61, the liquid contents transferred through the transfer element 61 are ejected to the interval between the teeth 62 and are applied to the hair.

Figure 18:
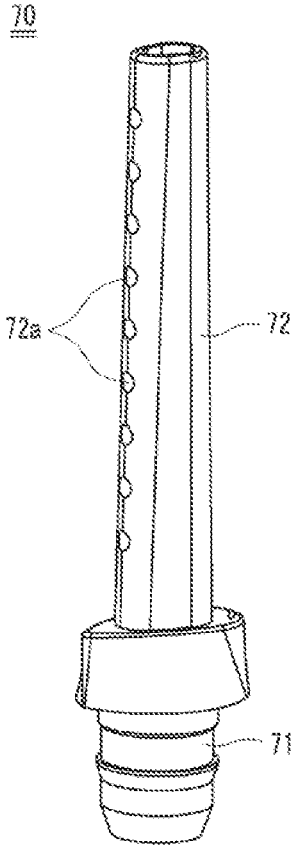
FIG. 18 is a perspective view illustrating a lining shown in FIG. 2.
Figure 19:
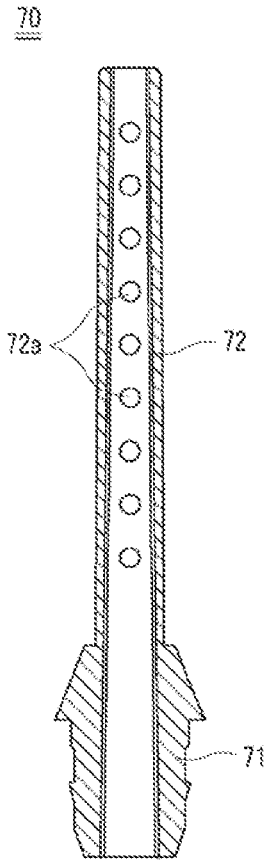
FIG. 19 is a longitudinal perspective view illustrating the lining of FIG. 18.

FIG. 18 is a perspective view illustrating the lining 70, and FIG. 19 is a longitudinal cross-sectional view illustrating the lining 70.

The lining 70 is inserted into the transfer element 61 of the comb 60 to be connected to the comb connection element 14 and supplies the liquid contents ejected through the comb connection element 14 to the interval between the teeth 62. The lining 70 is formed as a tube with a hollow transfer path formed therein and includes a fastened part 71 inserted into and fastened to the comb connection element 14 and an ejection part 72 extended from the fastened part 71 and formed with a plurality of ejection holes 72*a* for ejecting the liquid contents to the interval between the teeth 62.

The ejection holes 72*a* are arranged lengthways in a straight line to be located between the teeth 62.

Figure 20:
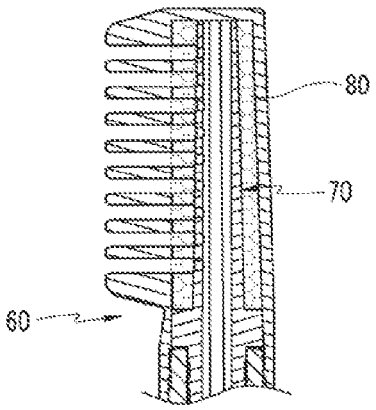
FIG. 20 is a partial extract view illustrating the comb of FIG. 3.

FIG. 20 is a partial extract view illustrating the comb 60.

A filter 80 surrounds the ejection part 72 of the lining 70 in the transfer part 61 of the comb 60 to allow the liquid contents ejected through the lining 70 to be evenly supplied to intervals of the teeth of the comb 60, which allows the liquid contents not to be massed into a lump but to be evenly ejected.

Figure 21:
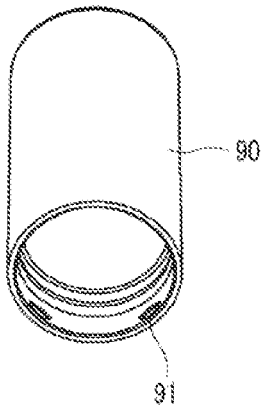
FIG. 21 is a perspective view illustrating a cover.
Figure 22:
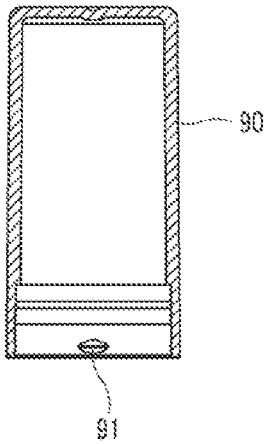
FIG. 22 is a longitudinal perspective view illustrating the cover of FIG. 21.

FIG. 21 is a perspective view illustrating the cover 90, and FIG. 22 is a longitudinal cross-sectional view illustrating the cover 90.

The cover 90 has an open end and is coupled with the outside of the cover coupling element 12 of the body 10 to be detachable. In the open end of the cover 90, a fastening protrusion 91 engaged with the fastening protrusion 12*a* formed on the outside of the cover coupling element 12 and preventing a separation of the cover 90 is protruded.

Figure 23:
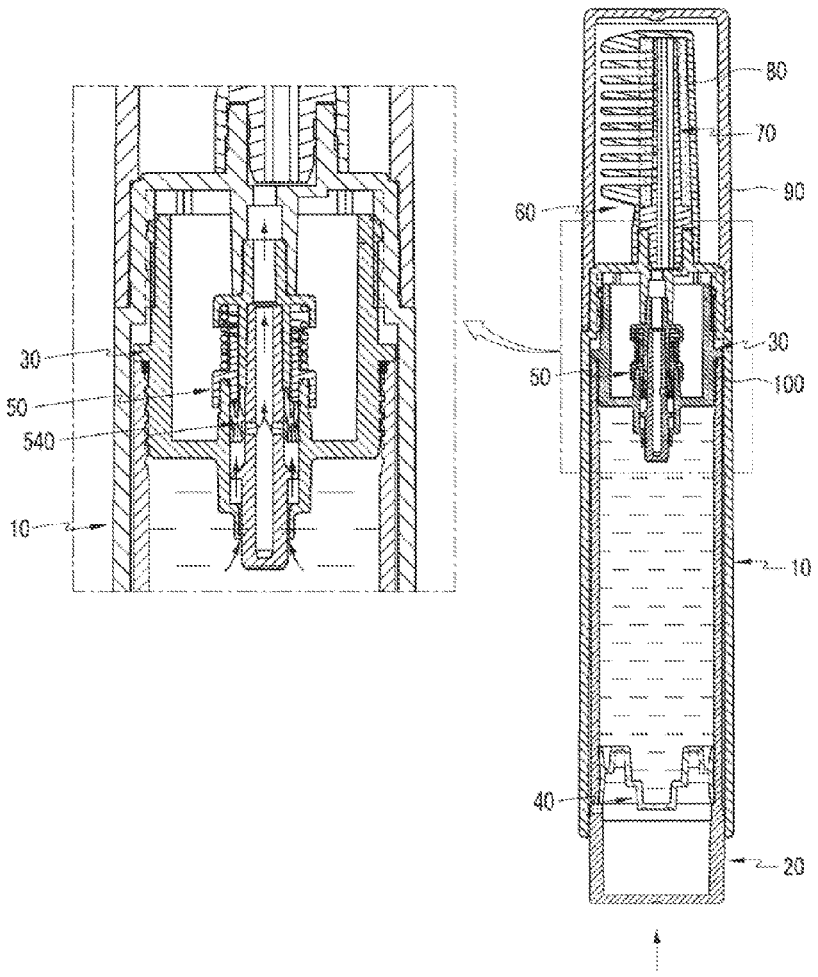
FIG. 23 is a cross-sectional view illustrating an ejection of contents of the container.

FIG. 23 is a cross-sectional view illustrating an ejection of the liquid contents of the container 20.

When the user pushes the closed other end of the container 20 exposed outwardly from the body 10, the container 20 and the container cap 30 slide toward the ejection hole 15 in the body 10. In this process, the sliding element 520 of the valve unit 50 is pushed by the container cap 30 and also slides toward the ejection hole 15.

When the sliding element 520 slides toward the ejection hole 15 and the force pressing the opening and closing element 540 is released, the opening and closing element 540 also slides toward the ejection hole 15 due to a pressure of the liquid contents applied to the opening and closing element 540 through the minute holes formed on the loop-shaped protrusion 512 of the nozzle 510.

That is, since there is a gap between the nozzle insertion element 33 of the container cap 30 and the nozzle body 511 of the nozzle 510, the liquid contents always fill the gap. Also, since the liquid contents are in contact with the opening and closing element 540 through the minute holes 512*a* of the loop-shaped protrusion 512, the pressure is always applied to the opening and closing element 540 from the liquid contents. Accordingly, as described above, when the pressing force of the sliding element 520 applied to the opening and closing element 540 is released, the opening and closing element 540 slides toward the ejection hole 15 of the body due to the pressure of the liquid contents.

When the opening and closing part 541 slides toward the ejection hole 15 in such a way that the gap groove 541*a* formed in the opening and closing part 541 coincides with the inflow hole 511*b* formed on the nozzle body 511, the liquid contents flows into the nozzle hole 511*a* through the gap groove 541*a* and the inflow hole 511*b*.

The liquid contents flowing into the nozzle hole 511*a* are ejected to the ejection part 72 of the lining 70 through the connection hole 550 connected to the nozzle body 511 and the valve connection part 13 of the body 10. After that, the liquid contents are ejected through the interval between the teeth 62 through the ejection hole 15 formed on the ejection part 72 and are applied to the hair.

The liquid contents are continuously ejected while pushing the closed other end of the container. An amount of the ejected liquid contents may be controlled by controlling time of pushing the other end of the container 20. Also, when pressing the container 20 repetitively, the liquid contents are ejected repetitively. Accordingly, the user may control the amount of the ejected liquid contents according to the time of pressing the container 20 or the number of pressing the container 20.

Figure 24:
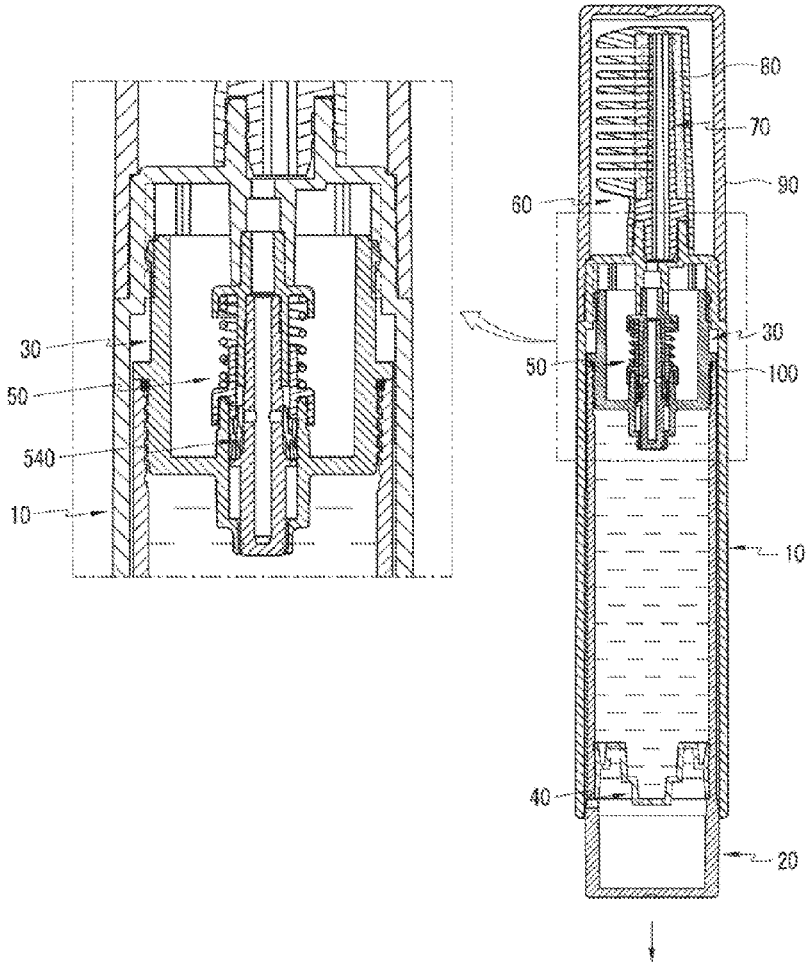
FIG. 24 is a cross-sectional view illustrating blocking an ejection of contents of the container.

FIG. 24 is a cross-sectional view illustrating blocking an ejection of contents of the container.

When taking off the hand from the other end of the container 20, the sliding element 520, the container cap 30, and the container 20 are restored to former conditions due to the restoration force of the spring 530. In this process, the opening and closing element 540 is pushed by the sliding element 520 and also slides till being in contact with the loop-shaped protrusion 512 of the nozzle 510.

When the opening and closing element 540 is in contact with the loop-shaped protrusion 512 of the nozzle 510, the gap groove 514*a* of the opening and closing element 540 does not overlap the inflow hole 511*b* of the nozzle body 511 and the inflow hole 511*b* is blocked by the opening and closing element 540. Accordingly, since an inflow of the liquid contents through the inflow hole 511 is blocked, the ejection of the liquid contents stops.

In this case, although the pressure of the liquid contents is continuously applied to the opening and closing element 540, since a pressure of the sliding element 520 to push the opening and closing element 540 is greater, the opening and closing element 540 is in contact with the loop-shaped protrusion 512 and maintains a state of blocking the inflow hole 511*b*.

As described above, since the transfer path of the liquid contents is perfectly blocked by the opening and closing element 540, it is possible to prevent a leakage of the liquid contents occurring while not being used.

The improved airtight liquid cosmetic container has effects as follows.

An amount of ejected contents may be freely controlled by controlling an amount of time for pressing the container or controlling intervals of pressing the container.

When releasing a force of pressing the container, an opening and closing element of a valve unit automatically blocks a transfer path of liquid contents, thereby preventing a leakage of the contents while not being used.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A liquid cosmetic container comprising:

a body formed with an ejection hole formed on a top portion of the body to eject liquid contents, a bottom portion of the body being formed as an open cylinder;

a container inserted into the body through an opening of the body to be slidable, a top portion of the container being formed as the open cylinder to be filled with the liquid contents therein;

a container cap screw-coupled with an opening of the container and having a through hole for passing the liquid contents through a central part; and a valve unit connecting the through hole and the ejection hole allowing the liquid contents in the container to be transferred to the ejection hole of the body while pressing the container and blocking the transfer of the liquid contents while releasing a force of pressing the container, wherein the valve unit comprises an opening and closing element sliding together with the container and the container cap, allows the opening and closing element to open a transfer path of the liquid contents to be ejected while the container is being pressed, and allows the opening and closing element to block an ejection of the liquid contents by closing the transfer path of the liquid contents while the force of pressing the container is released.

2. The container of claim 1, wherein the valve unit comprises:

a nozzle penetrating the container cap and formed with a nozzle hole connected to the ejection hole therein and with an inflow hole connected to the nozzle hole and allowing the liquid contents to flow into the nozzle hole on a side thereof;

a sliding element put on the outside of the nozzle to be movable and pushed by the container cap and sliding toward the ejection hole while the container and the container cap are sliding toward the ejection hole;

an elastic element elastically supporting the sliding element with respect to the ejection hole and restoring the sliding element to a former condition when a force of pushing the container and the container cap is released; and the opening and closing element put on the outside of the nozzle to be movable, pushed toward the ejection hole and opening the inflow hole due to a pressure of the liquid contents flowing into a gap between the container and the nozzle while the sliding element is sliding toward the ejection hole, and pushed by the sliding element to be restored to a former condition and blocking the inflow hole when the sliding element is restored to the former condition.

3. The container of claim 2, wherein the nozzle comprises:

a nozzle body formed with the nozzle hole whose one end is open therein and with the inflow hole on a side thereof; and a loop-shaped protrusion formed on a location in the side of the nozzle body, separated from the inflow hole to another end of the nozzle body and formed with minute holes through which the liquid contents flowing into a gap between the other end of the nozzle body and the container cap pass, wherein the opening and closing element is put on a part of the nozzle body to be movable, where the minute holes are formed, with the loop-shaped protrusion as a reference, and wherein, when the sliding element slides toward the ejection hole and a force of pushing the opening and closing element toward the loop-shaped protrusion is released, the liquid contents flowing into the container cap applies a pressure to the opening and closing element through the minute holes and pushes the opening and closing element to slide toward the ejection hole.

4. The container of claim 3, wherein the valve unit further comprises a connection hole in the body, the connection hole connecting the ejection hole to the nozzle and supporting the elastic element.

5. The container of claim 4, wherein the connection hole comprises:

a connection part formed as a hollow tube whose one end is inserted into a valve connection part extended to be the ejection hole in the body, an open end of the nozzle body being inserted into another end thereof, the elastic element being put on the outside of the other end; and an elastic element supporting part extended outwardly from the connection part and supporting the elastic element.

6. The container of claim 1, wherein the container cap comprises:

a screw-coupled element having a cylindrical shape and coupled with the opening of the container;

a blocking plate vertically extended from one end of the screw-coupled element toward the inside and blocking a discharge of the liquid contents in the container; and a nozzle insertion element, which is hollow inside, extended to be orthogonal to a center of the blocking plate, the nozzle being inserted therein to be slidable.

* * * * *